US010583492B2

(12) United States Patent
Hanusiak et al.

(10) Patent No.: US 10,583,492 B2
(45) **Date of Patent: *Mar. 10, 2020**

(54) TITANIUM POWDER PRODUCTION APPARATUS AND METHOD

(71) Applicant: CARPENTER TECHNOLOGY CORPORATION, Philadelphia, PA (US)

(72) Inventors: William M. Hanusiak, Windermere, FL (US); Dale R. McBride, Bruceton Mills, FL (US)

(73) Assignee: CARPENTER TECHNOLOGY CORPORATION, Philadelphia, PA (US)

( * ) Notice: Subject to any disclaimer, the term of this patent is extended or adjusted under 35 U.S.C. 154(b) by 229 days.

This patent is subject to a terminal disclaimer.

(21) Appl. No.: 15/588,993

(22) Filed: May 8, 2017

(65) Prior Publication Data

US 2018/0169762 A1 Jun. 21, 2018

Related U.S. Application Data

(60) Provisional application No. 62/437,129, filed on Dec. 21, 2016.

(51) Int. Cl.
*B22F 9/08* (2006.01)
*C22C 1/04* (2006.01)

(52) U.S. Cl.
CPC ..... *B22F 9/082* (2013.01); *C22C 1/0458* (2013.01); *B22F 2009/0824* (2013.01); *B22F 2009/0848* (2013.01); *B22F 2009/0888* (2013.01); *B22F 2009/0892* (2013.01); *B22F 2009/0896* (2013.01); *B22F 2999/00* (2013.01)

(58) Field of Classification Search
None
See application file for complete search history.

(56) References Cited

U.S. PATENT DOCUMENTS

| | | | | |
|---|---|---|---|---|
| 4,544,404 | A | 10/1985 | Yolton et al. | |
| 5,164,097 | A * | 11/1992 | Wang | B22D 41/52 222/590 |
| 5,213,610 | A * | 5/1993 | Yolton | B22D 21/00 75/338 |
| 5,855,642 | A | 1/1999 | Miller et al. | |
| 9,956,615 | B2 * | 5/2018 | Hanusiak | B22F 9/082 |

(Continued)

FOREIGN PATENT DOCUMENTS

| | | |
|---|---|---|
| JP | 02-070010 | 3/1990 |
| JP | 05-345905 | 12/1993 |

OTHER PUBLICATIONS

Search Report and Written Opinion dated Aug. 16, 2017, issued in PCT/US2017/031685 (11 pages).

*Primary Examiner* — George Wyszomierski
(74) *Attorney, Agent, or Firm* — Nixon & Vanderhye PC

(57) ABSTRACT

A method and apparatus for producing titanium metal powder from a melt. The apparatus includes an atomization chamber having an inner wall that is coated with or formed entirely of a titanium alloy that is the same as the titanium metal powder to prevent contamination of titanium metal powder therein. The inner surfaces of some or all components of the apparatus in a flow path following the atomization chamber may also be coated with or formed entirely of the titanium alloy or CP-Ti.

7 Claims, 1 Drawing Sheet

(56) References Cited

U.S. PATENT DOCUMENTS

| | | | | |
|---|---|---|---|---|
| 2013/0233129 | A1 | 9/2013 | Hanusiak et al. | |
| 2016/0144435 | A1 * | 5/2016 | Banik | B22F 9/082 75/338 |

* cited by examiner

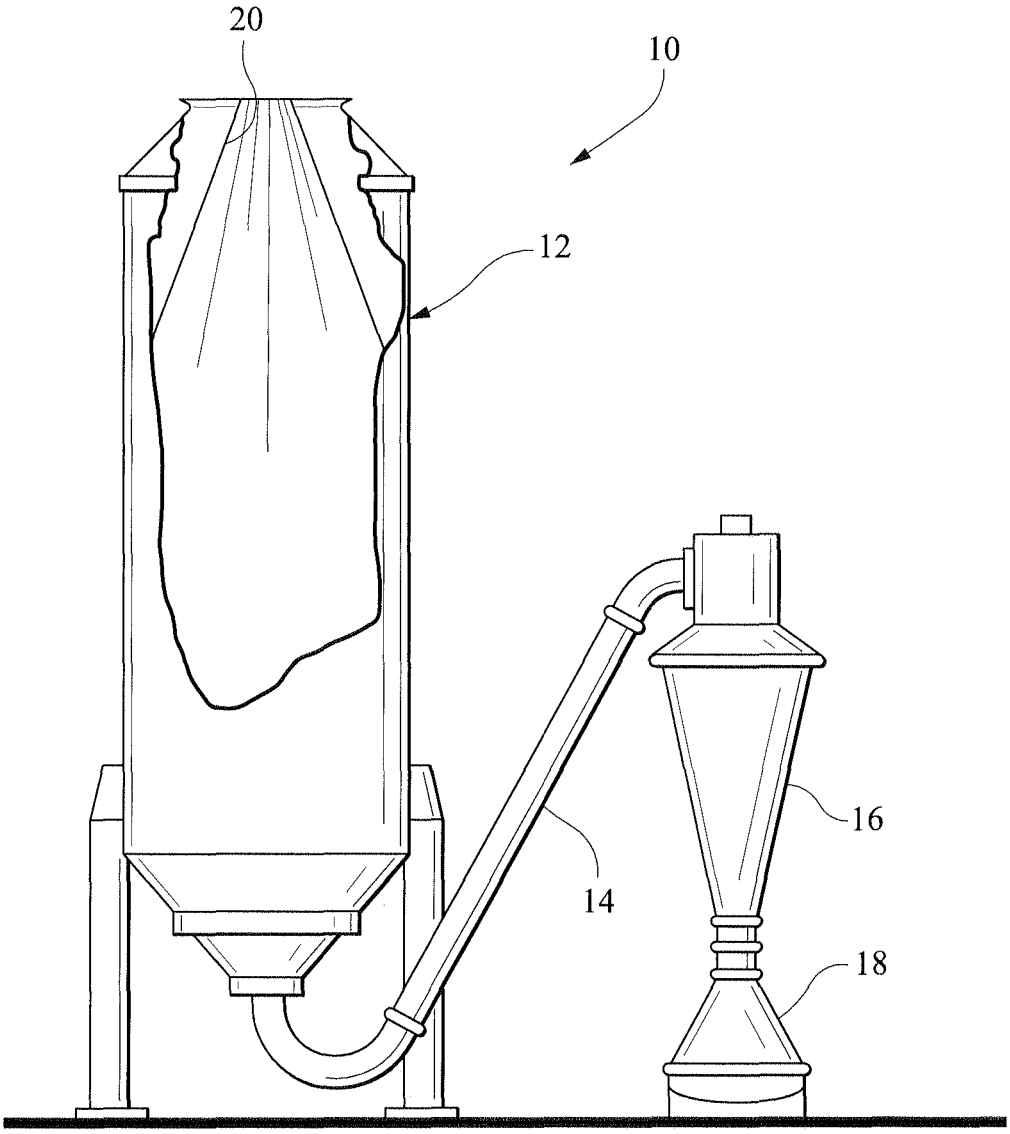
20
10
12
16
14
18

TITANIUM POWDER PRODUCTION APPARATUS AND METHOD

CROSS-REFERENCES TO RELATED APPLICATIONS

This application claims the priority of Provisional Patent Application No. 62/437,129 filed on Dec. 21, 2016 and entitled "TITANIUM POWDER PRODUCTION APPARATUS AND METHOD".

BACKGROUND OF THE INVENTION

1. Field of the Invention

The present invention relates to a titanium powder production apparatus and method and, more particularly, to such an apparatus and method that prevents contamination of the titanium powder.

2. Description of the Background Art

Powder metallurgy is an important technology in the production of parts made out of titanium for critical applications such as aerospace. Titanium metal powder is the basic raw material in this process path. Atomization using an inert gas such as argon is a commonly used process to produce uniform spherical-shaped powders that possess high packing densities. A typical device for gas atomization consists of a liquid metal stream supply source, the atomizing gas jet, and a cooling chamber. The free-falling stream of molten titanium is impinged with inert gas jet at a high velocity, the atomized droplets of titanium solidify in flight through the chamber, and are collected at the bottom of the chamber. Extremely high values of cooling rates during the solidification of the droplets are desired in order to obtain very specific, controlled structures. Several aspects of design and construction of the atomization chamber are important:

1. The chamber must be constructed with a material that does not react with titanium up on contact;
2. The chamber must be large enough to allow titanium droplets to solidify before they come in contact with the walls or bottom section of the chamber;
3. The chamber should allow complete evacuation to prevent atmospheric contamination; and
4. The chamber design should allow easy access for complete cleaning and inspection of its interior.

Stainless steel is the most commonly used material for the construction of titanium atomization chambers. There exists a possibility that some of titanium droplets hit the atomization chamber before solidification. These droplets react with stainless steel producing low-melting point compounds that are brittle in nature. These compounds enter into the titanium powder stream as contaminants and remain undetected in standard quality control techniques. Components made out of these contaminated powders experience catastrophic in-service failures.

BRIEF SUMMARY OF THE INVENTION

In accordance with the present invention, the powder metal contamination can be eliminated by lining the metal powder flow path or fabricating the metal powder flow path beyond the atomization stage with a metal that is non-contaminating to the metal powder being produced.

In the case of titanium metal powder, the wall of the atomization chamber preferably is lined or fabricated from a titanium alloy that is the same as the titanium metal powder. For example, a titanium alloy such as Ti-6Al-4V could be used for the liner or chamber wall if the titanium powder metal being produced is Ti-6Al-4V.

This solution applies to any powder metal production system, since metal contamination can be created in the chamber cleaning operation, it is particularly applicable to metal powder production from a melt as this method experiences occasional powder ball to chamber wall bonding.

Atomization from a melt includes gas atomization (GA) in which a molten stream of metal is impinged by a high velocity inert gas jet to form a powder, and spinning electrode methods (PREP) in which the end of a metal bar is melted while the bar rotates rapidly throwing off metal droplets.

In either case, melting can be achieved by electron beam, plasma torch, electrical arc, induction heating, laser heating or any other sufficiently powerful heating method.

BRIEF DESCRIPTION OF THE DRAWING

FIG. 1 is a schematic view of a portion of apparatus for producing titanium powder.

DETAILED DESCRIPTION OF THE INVENTION

Referring to FIG. 1, apparatus 10 for producing titanium powder includes an atomization or hot spray chamber 12 for receiving an atomized liquid metal stream supply from a known system such as a cold wall induction guiding system, an electrode induction melting gas atomization process, a plasma-melting induction-guiding gas atomization method, a triple melt process or any other known system. The powder from the atomization chamber 12 is passed through a conveying tube 14, through a cyclone separator 16 and then into powder containers 18, as shown in FIG. 1.

In accordance with the present invention, the entire inside surface 20 of the atomization chamber 12 is coated with or formed of a titanium alloy that is the same as the titanium metal powder being produced from a melt including titanium powder metal as hereinbefore described. As an illustrative example, a coating of a titanium alloy on the inner surface 20 of the atomization chamber 12 may have a thickness of about 2 mm. The atomization chamber may be formed of any suitable material, such as stainless steel. Alternatively, the atomization chamber 12 can be formed of the titanium alloy instead of a coating of the alloy on the inner surface formed of another material.

To further ensure against contamination of the titanium powder, all or part of the flow path after the atomization chamber 12 may be coated with or formed of a titanium alloy the same as the titanium powder or commercially pure titanium (CP-Ti). For example, one or more of the conveying tube 14, cyclone separator 16 and/or powder containers 18 may be formed of or coated internally with the titanium alloy or CP-Ti to prevent any contamination of the titanium powder.

As an illustrative example, a titanium alloy such as Ti-6Al-4V could be used for the liner or chamber wall 20 in the atomization chamber 12 and all or part of the subsequent flow path if the titanium powder metal being processed is Ti-6Al-4V.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An Apparatus for producing titanium metal powder from a melt including titanium powder metal, comprising an atomization chamber having an inner wall that is coated with or formed entirely of a titanium alloy that is the same as the titanium metal powder to prevent contamination of titanium metal powder therein, wherein inner surfaces of one or more components of the apparatus in a flow path following the atomization chamber are coated with the titanium alloy or commercially pure titanium (CP-Ti) or the inner surfaces are formed entirely of the titanium alloy or commercially pure titanium (CP-Ti).

2. An Apparatus for producing titanium metal powder from a melt including titanium powder metal, comprising:

an atomization chamber having an inner wall that is coated with or formed entirely of a titanium alloy that is the same as the titanium metal powder to prevent contamination of titanium metal powder therein, and a powder conveying tube connected to an exit opening of the atomization chamber, a cyclone separator connected to the powder conveying tube and a powder container connected to the cyclone separator, and wherein inner surfaces of one or more of the conveying tube, the cyclone separator and/or the powder container are coated with or formed entirely of the titanium alloy or commercially pure titanium (CP-Ti).

3. The apparatus of claim 1 wherein the inner wall of the atomization chamber is coated with a titanium alloy having a thickness of about 2 mm.

4. A method for preventing contamination of titanium powder in an apparatus for producing it from a melt including titanium powder metal, the apparatus having an atomization chamber with an inner wall, comprising:

coating the inner wall or forming it entirely of a titanium alloy that is the same as the titanium powder, and coating inner surfaces of one or more components of the apparatus in a flow path following the atomization chamber with the titanium alloy or commercially pure titanium (CP-Ti) or forming the inner surfaces entirely of the titanium alloy or commercially pure titanium (CP-Ti).

5. The method of claim 4 wherein the coating of the titanium alloy on the inner wall is about 2 mm.

6. A method for preventing contamination of titanium powder in an apparatus for producing it from a melt including titanium powder metal, the apparatus having an atomization chamber with an inner wall, comprising:

coating the inner wall or forming it entirely of a titanium alloy that is the same as the titanium powder, wherein the apparatus further comprises a conveying tube, a cyclone separator and a powder container in a flow path following the atomization chamber, and the method further comprises coating inner surfaces of one or more of the conveying tube, the cyclone separator and/or the powder container with the titanium alloy or commercially pure titanium (CP-Ti) or forming the inner surfaces entirely of the titanium alloy or commercially pure titanium (CP-Ti).

7. An Apparatus for producing titanium metal powder from a melt wherein a stream of molten titanium is impinged with inert gas at high velocity in an atomization chamber having an inner wall, and wherein the inner wall is coated with or formed entirely of a titanium alloy that is the same as the titanium metal powder to prevent contamination of the metal powder, wherein inner surfaces of one or more components of the apparatus in a flow path following the atomization chamber are coated with the titanium alloy or commercially pure titanium (CP-Ti) or the inner surfaces are formed entirely of the titanium alloy or commercially pure titanium (CP-Ti).

* * * * *